United States Patent [19]

Unger

[11] Patent Number: 4,472,112

[45] Date of Patent: Sep. 18, 1984

[54] PRESSURE CONTROL ARRANGEMENTS FOR AN AIR COMPRESSION SYSTEM

[75] Inventor: Herbert Unger, Springe, Fed. Rep. of Germany

[73] Assignee: WABCO Fahrzeugbremsen GmbH, Hanover, Fed. Rep. of Germany

[21] Appl. No.: 423,965

[22] Filed: Sep. 27, 1982

Related U.S. Application Data

[62] Division of Ser. No. 143,393, Apr. 24, 1980, abandoned.

[30] Foreign Application Priority Data

May 8, 1979 [DE] Fed. Rep. of Germany ..... 2918482

[51] Int. Cl.[3] ..... F04B 49/08

[52] U.S. Cl. ..... 417/311

[58] Field of Search ..... 47/307, 311; 137/488, 137/492.5, 93

[56] References Cited

U.S. PATENT DOCUMENTS 3,255,954 6/1966 Norlin et al. ..... 417/311 X 3,545,887 12/1970 Kobnick ..... 417/307

*Primary Examiner*—Richard E. Gluck

*Attorney, Agent, or Firm*—J. B. Sotak

[57] ABSTRACT

This disclosure relates to a pressure control arrangement for an air compressor. The pressure control arrangement includes an auxiliary pressure chamber which is vented to the atmosphere by the auxiliary pressure chamber is connected to the compression chamber of the air compressor by a spring biased piston controlled valve which is normally closed. When the air pressure exceeds a predetermined value, the piston controlled valve is opened by the air pressure to vent the compression chamber to the atmosphere.

6 Claims, 4 Drawing Figures

PRESSURE CONTROL ARRANGEMENTS FOR AN AIR COMPRESSION SYSTEM

FIELD OF THE INVENTION

This is a division of application Ser. No. 143,393, filed Apr. 24, 1980 now abandoned.

This invention relates to air pressure control systems and more particularly to pneumatic control arrangements for air compressors which regulate the operating pressure by venting the compression chamber through a piston controlled valve auxiliary pressure chamber.

BACKGROUND OF THE INVENTION

In the past, the maximum and minimum pressures of a compressed air generating system including an air compressor and storage reservoir were normally adjusted by means of control devices which were arranged between the air compressor and the storage reservoir. Previously, pressure control devices were employed to interrupt any further pressure build-up in the storage reservoir when the adjusted maximum pressure is reached. One manner of accomplishing this was to have a valve divert the flow of the compressed air generated by the air compressor into the atmosphere. Another way was to switch the air compressor to its idling position. In the latter case, switching to the idling phase was accomplished by establishing a fluid connection between the suction chamber and the compression chamber of the air compressor.

Such pressure regulating systems are well known and are fully described in German Pat. No. 1,550,138 and allowed German application No. 27 26 494.

However, when discharging into the atmosphere, the pressure control valve must be installed in the unit in such a way that a length of spiral tubing should be connected to the discharge end of the air compressor. In practice, a length of 1.5 to 2 meters of tubing will sufficiently cool the heated compressed air so that the temperature at the intake nozzle of the pressure regulating valve will not exceed +150° C. This ensures that the entire capacity of the air compressor will be completely evacuated into the atmosphere during each discharge cycle, and likewise that the tubing will be filled to maximum by atmospheric pressure on each intake stroke.

However, there is a disadvantage in switching the air compressor to its idling position in that the air compressor is only partly cooled. It will be appreciated that during the idling operation there is little, if any, air being sucked into the compressor so that part of the cooling air need for cooling the air compressor is therefore lost. This is also the case in self-stabilizing types of air compressors.

OBJECTS OF THE INVENTION

Accordingly, it is an object of the present invention to provide a compressed-air generating unit in which the full time of the unit does not depend upon the volume of the discharge line, and in which the cooling of the air compressor does not rely on outside air.

A further object of the invention is to provide a new and improved pressure control arrangement for an air compression system.

Another object of this invention is to provide an air compression system having an air compressor and at least one storage reservoir in which the operating pressure is controllable, the combination with a cylinder head and a piston-cylinder assembly, the cylinder head having a suction chamber which is opened to the atmosphere and having a pressure chamber which is provided with a discharge opening, at least one suction valve connecting the suction chamber with a compression chamber which is formed by the piston-cylinder assembly, at least one pressure valve connecting the pressure chamber with the compression chamber, a pipeline connecting the discharge opening of the pressure chamber to the storage reservoir, a pressure control valve device controlled by the pressure in the storage reservoir, characterized by, the cylinder head having a pressure control chamber which is opened to the atmosphere, a pressure control valve in the pressure control chamber for normally closing a port between the compression chamber and the pressure control chamber, a pneumatically actuated control piston in the pressure control chamber for controlling the pressure control valve, and when the pressure in the storage reservoir exceeds a predetermined value, the pressure control valve device pressurizes the pneumatically actuated control piston to cause the pressure control valve to open the port so that the compression chamber is vented to the atmosphere through the pressure control chamber.

An additional object of this invention is to provide a unique air pressure control system which is economical in cost, durable in use, reliable in service, efficient in operation, and simple in design.

SUMMARY OF THE INVENTION

In accordance with the present invention, there is provided a pressure control arrangement for controlling the operating pressure of an air compressor. When the pressure in the storage reservoir exceeds a predetermined value, air is conveyed via a passageway to an expansion chamber which contains a spring biased control piston. The air pressure causes the control piston to be shifted upwardly to open a closed valve port between the compression chamber and an auxiliary chamber. Thus, the excess air pressure in the compression chamber is directly diverted into the atmosphere via an auxiliary valve control pressure valve which is arranged between the compression chamber and the auxiliary pressure chamber. Since the same pressure conditions always prevail in the line between the air compressor and the storage reservoir, there is no longer any discharge of part of this line into the atmosphere. Because the intake air continues to flow during idling, the cooling of the air compressor is not disturbed. This provides for a reduction in carbon deposits and better heat dissipation. Heating the air by flow resistances in the valve during the idling phase is out of the question. The air is no longer pushed back and forth during the idling of the air compressor, so that the oil consumption is reduced. Further reduction in the oil consumption can be achieved advantageously by selecting the cross section of the valve port in the auxiliary chamber in such a way that a certain counter pressure is achieved in the idling phase.

BRIEF DESCRIPTION OF THE DRAWINGS

The above objects and other attendant features and advantages of the present invention will become more readily apparent from the following detailed description when analyzed and considered in conjunction with the accompanying drawings, wherein.

DETAILED DESCRIPTION OF THE INVENTION

Figure 1:
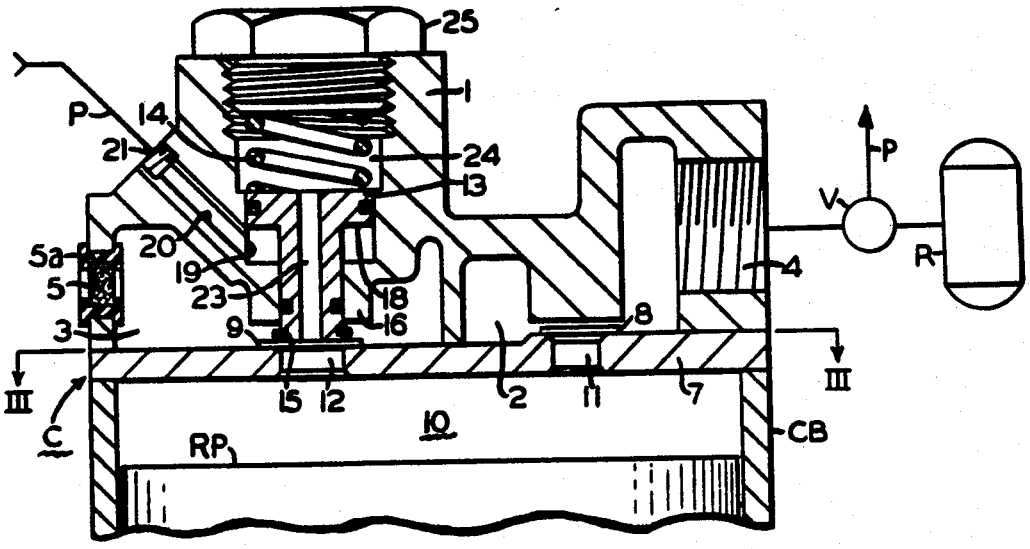
FIG. 1 is a partial cutaway or sectional view of the pressure side of an air compressor with an auxiliary pressure control chamber, pressure control valve and control piston of an air compression system in accordance with the present invention.

Referring now to the drawings, and in particular to FIG. 1, there is shown a partial cutaway view of an air compressor generally characterized by the letter C. As shown, the air compressor C includes a piston-cylinder assembly and a cylinder head. The cylinder head which is denoted by numeral 1 includes a pressure or discharge chamber 2 and an auxiliary or separate pressure control chamber 3. An opening or discharge orifice 4 is used for the connection of a suitable pressure pipe or line leading to a fluid pressure storage tank or reservoir R while a discharge opening or exhaust orifice 5 is provided for selectively venting or evacuating the pressure control chamber 3, as will be described hereinafter. In viewing FIG. 3, it will be seen that the cylinder head 1 also includes a suction or intake chamber 6 as well as a suction valve (shown by the dashed lines) which is a conventional part of reciprocating types of air compressors. However, since the details of the intake valve portion are not considered pertinent to an understanding of the invention, no further description will be made at this time. It will be noted that a valve seat plate 7 is located between the bottom of cylinder head 1 and the top of the cylinder body CB. The valve plate 7 carries a leaf spring pressure valve 8 and a leaf spring auxiliary pressure control valve 9. The valves 8 and 9 are adapted to cooperate with a plurality of openings or ports 11 and 12 leading to a compression chamber 10 which is formed by the cylinder CB and the top of reciprocable piston RP. As shown in FIG. 1, the vented opening or port 5 of pressure control chamber 3 is provided with a filter or screen 3*a* to prevent dirt from entering the chamber and has a sound damping effect. In viewing FIG. 1, it will be seen that the cylinder head 1 is bored out to accommodate a vertically slidable control piston 13. The pneumatically actuated piston 13 is situated above the pressure control valve 9 and is normally biased downwardly by a compression spring 14 to engage the top side of valve 9. Thus, the valve 9 normally seals off the pressure control chamber 3 from the fluid pressure forces built up in the compression chamber 10. In order to limit the vertical movement or upward stroke of control piston 13, there is provided a stop member or snap ring 15 which fits into an annular groove formed near the lower extremity of piston 13. Thus, the ring 15 engages the under surface of a hollow tubular guide portion 16 formed in the cylinder head casing 1 to limit the upper movement. The piston 13 includes an enlarged upper head portion 18 which includes a peripheral annular groove for accommodating an O-ring seal forming an effective seal with counterbore or annular chamber 19. The bore 20 communicates with a passageway 20 which terminates with a pipe connection 21. One end of a pipe line P fits into connector 21 while the other end of pipe P is connected to a pressure relief control valve V which functions to control the operating pressure in the cylinder bore 19. A central through bore 23 is formed in the valve control piston 13 and allows for the bleed-off or evacuation of air from an annular spring accommodating chamber 24. As shown, the helical spring 14 is placed in the chamber 24 and is trapped between the top of piston 13 and the underside of a threaded cap member 25 which is screwed into the cylinder head 1. Referring now to the control arrangement shown in FIG. 2 which substantially corresponds in design to that illustrated in FIG. 1, it will be observed that the parts which have been slightly modified are represented by a primed number. It will also be noted that the means for limiting the extreme upward movement of the control piston 13' now consists of the top of a piston 13' and the underside 15*a* of a screw plug or threaded cap member 17. In addition, it will be seen that spring 14' is disposed within a counterbore 24' formed in the upper end of piston 13'. The compression spring 14' is trapped between the lower end of counterbore 24' and a spring seat SS. As shown, an adjustment screw 22 is threaded into the cap member 25' so that its free end is seated into an indentation in seat SS. Thus, the tension of the compression spring 14' may be adjusted to the desired value by turning the set screw in or out as the situation warrants.

Figure 2:
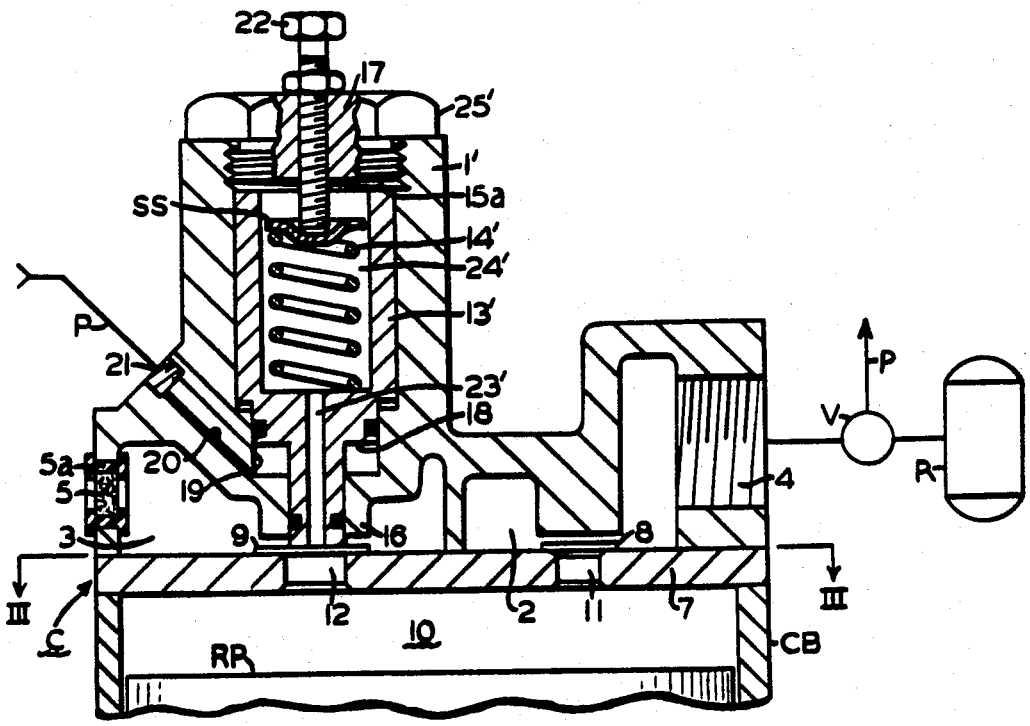
FIG. 2 is a slightly modified embodiment of the pressure control system of FIG. 1 with an adjustable spring for the control piston.

Let us now turn to the operation of the pressure control systems illustrated in FIGS. 1 and 2. Let us assume that the pressure control values are in the position as shown so that the pistons 13 and 13' cause the valve member 9 to close off the pressure relief port 12. Now if the operating pressure in the storage reservoir R reaches the pressure setting of the relief valve V, the normally closed relief valve V becomes opened and allows passage of compressed air through pipe P to connector 20, through passageway 21 and into annular expansion chamber or operating cylinder 19. The preponderance of fluid pressure on the underside of annular head 18 causes the control piston 13 to lift and move upwardly against the tension of spring 14 until stop ring 15 engages the underside of guide 16. Thus, resiliency of the pressure control leaf spring valve 9 uncovers port 12 to cause the compression chamber 10 to communicate with the auxiliary pressure control chamber 3 and to the atmosphere via the screened opening 5. Thus, the pressure control valve 9 takes over the function of the discharge valve 8, since this valve 8 remains closed by means of the back pressure of the air compressor. Therefore, the compressed air escapes through pressure control chamber 3 and through the screened opening 5 into the atmosphere. Now when the operating pressure in the reservoir drops to a predetermined value, the control valve 9 switches the flow direction again toward the storage reservoir. That is, when the pressure in the annular chamber 19 decreases sufficiently, the force of the spring 14 causes a downward stroke of the operating piston 13, so that the pressure control valve 9 closes the port 12, and the pressure valve 8 resumes its original function.

Figure 3:
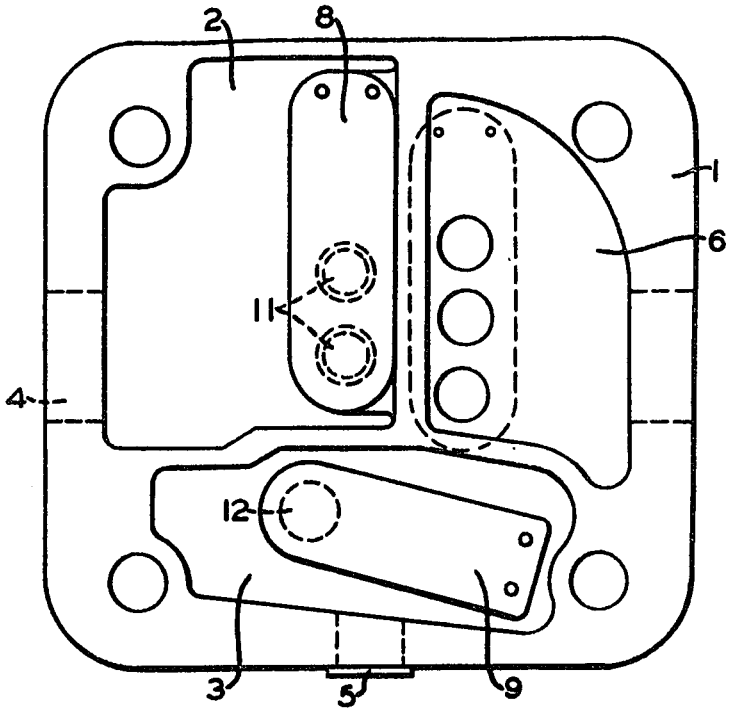
FIG. 3 is a cross-sectional view of the cylinder head taken substantially along lines II—II of FIGS. 1 and 2.
Figure 4:
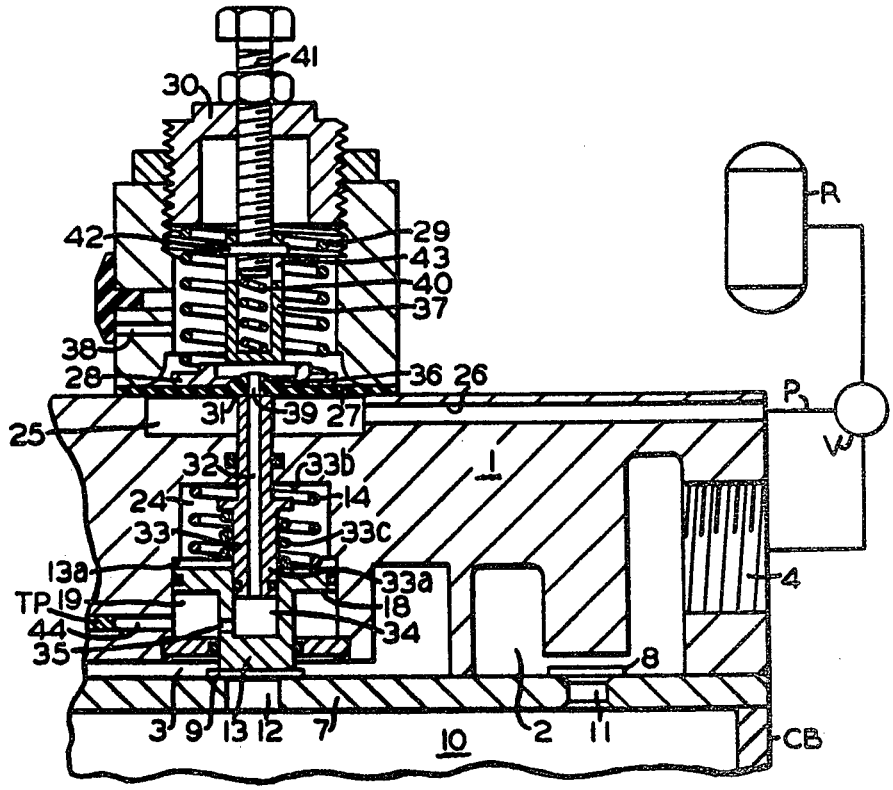
FIG. 4 is a partial sectional view of another embodiment of the present invention, having an additional starting pressure control valve incorporated in the cylinder head.

Turning now to FIG. 4, there is shown a control arrangement that is slightly different in construction and function than that described in relation to the embodiments of FIGS. 1, 2 and 3.

In viewing FIG. 4, it will be seen that there is a pressure chamber 25 above the operating piston 13 which is connected via a passageway 26 with a source of compressed air, such as, in a storage reservoir R which is supplied by the air compressor. As shown, a rubber or flexible diaphragm 27 is situated between the pressure control device that is connected with the cylinder head 1. The diaphragm 27 is disposed above the pressure chamber 25. Resting on the upper side of the diaphragm 27 is a lower spring retaining plate 28 which engages the lower end of compression spring 29. The compressive force of spring 29 works against the air pressure in the pressure chamber 25. The spring 29 is trapped between the retaining plate 28 and peripheral edge of an adjustable screw cap 30. Thus, the spring pressure exerted by spring 29 is set at a preselected value by turning the screw cap 30.

It will be seen that the bottom side 31 of diaphragm 27 engages and seals the through bore 32 of a tappet or push rod 33 to form a first intake valve. The upper end of the push rod 33 passes through an O-ring sealed hole formed in the bottom wall of chamber 25 and extends into chamber 24 of control piston 13. The enlarged bottom end **33*a* of movable tappet 33 protrudes into a central recess 34 of the control or operating piston 13. A through hole 35 provides a connection between the annular chamber 19 of control piston 13 and central chamber 34 of tappet 33. A passageway 44 which is presently plugged by pipe plug TP may be adapted to be connected to the storage reservoir R similar to passageways 20 of FIGS. 1 and 2**.

An apertured thickened portion 36 is formed in the central area of the rubber diaphragm 27. It will be appreciated that a valve body 37 and the apertured center portion 39 form a second or discharge valve. The various chambers and holes are vented to the atmosphere via a passageway or opening 38. It will be noted that the hole 39 in the thickened center portion on the diaphragm 36 is aligned with the through bore 32 of tappet 33. Internally situated in the cylindrical valve body 37 is a small compression spring 40. As shown, the bottom end of the spring 40 rests against the bottom cup-shaped valve body 37 and has its top end resting against the bottom surface of a set screw 41. The bottom or free end of set screw 41 slightly protrudes into the open end of the valve body 37. A horizontal pin 42 is fitted into the bottom protruding end of the set screw 41 to hold the valve body 37 in position. It will be seen that a pair of diametrically opposed vertical slots 43 are formed in the cylindrical wall of valve 37 to accept the ends of pin 42 to permit restricted vertical movement or a certain amount of lost motion between the set screw 41 and valve body 37. Let us now assume that the various parts are in the position as shown in FIG. 4 and that the operating pressure of the compressor and storage pressure in the reservoir are to be controlled in accordance with the need of the air brake system.

It will be appreciated that compressed air is supplied from the reservoir R to the pressure chamber 25 via passageway 26. It will be seen that the tension or compressive force of spring 29 is preset by adjusting the screw cap 30. Now when pressure in the storage reservoir overcomes the compressive force of spring 29, the diaphragm 27 is flexed upwardly, and the tappet 33 is allowed to move upwardly under action of compression spring **33*c*. That is, the spring 33*c* urges the push rod 33 upwardly until the top of the tappet body 33*a* engages the under surface 33*b*. Additionally, hole 39 is sealed by thickened portion 36 engaging valve body 37. As the diaphragm 27 continues to flex upwardly, it lifts the seat 31 off the tappet 33 so that the compressed air in chamber 25 is allowed to flow through the through hole 32, into the chamber 34, through channel 35 and into the annular chamber 19 of control piston 13. Thus, the control piston 13 is then lifted against the compressive force of spring 14 until it reaches stop 13*a*. As described in the operation of FIGS. 1, 2 and 3, the compressed air, generated in the compression chamber 10 by the air compressor, is now allowed to flow through bore 12, past the open pressure control valve 9, into pressure control channel 3** and out into the atmosphere.

Now, as the pressure in the system drops again, the rubber diaphragm 27 begins to retract and is assisted by compression spring 29 via spring plate 28 to press against the top of tappet 33 thereby closing the sealed seat 31.

When the start-up pressure is reached, the valve body 37 is held in the position shown by pin 42, and compressed air in the annular chamber 19 can escape via channel 35, chamber 34, holes 32 and 39 through the discharge opening 38 to the atmosphere. Now, the compressive force of spring 14 moves piston 13 downward so that the pressure control valve 9 seats against the top of port 12 and seals off the compression chamber. Thus, the air compressor again starts sending compressed air into the reservoir R.

The cut-off pressure can be varied and set by adjusting screw cap 30 while the start-up pressure can be varied and set by adjusting set screw 41.

It will be appreciated that various changes, modifications, and alterations may be made by persons skilled in the art without departing from the spirit and scope of the present invention. Thus, it will be understood that certain variations may be made to the above-described invention and, therefore, it is intended that the subject invention be limited only as indicated by the scope of the appended claims.

Having thus described the invention, what I claim as new and desired to secured by Letters Patent, is:

1. In an air compression system including an air compressor and at least one storage reservoir in which the operating pressure is controllable, the combination with a cylinder head and a piston-cylinder assembly, the cylinder head having a suction chamber which is opened to the atmosphere and having a pressure chamber which is provided with a discharge opening, at least one suction valve connecting the suction chamber with a compression chamber which is formed by the piston-cylinder assembly, at least one pressure valve connecting the pressure chamber with the compression chamber, a pipeline connecting the discharge opening of the pressure chamber to the storage reservoir, a pressure control valve device controlled by the pressure in the storage reservoir, characterized by, said cylinder head having a pressure control chamber which is opened to atmosphere, a pressure control valve in said pressure control chamber for normally closing a port between the compression chamber and said pressure control chamber, a pneumatically actuated control piston in said pressure control chamber for controlling said pressure control valve, and when the pressure in the storage reservoir exceeds a predetermined value, the pressure control valve device pressurizes said pneumatically actuated control piston to cause said pressure control valve to open said port so that the compression chamber is vented to the atmosphere through said pressure control chamber, and said pressure control valve device includes a flexible diaphragm which is designed as a double valve seat to which said pressure from the storage reservoir is applied via a pressure chamber.

2. The air compression system according to claim 1, wherein one of said double valve seats is situated on the bottom side of the diaphragm which together with a first valve body forms an intake valve, and the other of said double valve seats is situated on the upper side of the diaphragm which together with a second valve body forms a discharge valve.

3. The air compression system according to claim 2, wherein said first valve body takes the form of a movable tappet having a through hole which provides a fluid connection between said pressure chamber and an annular chamber of the pneumatically actuated control piston when said intake valve is opened.

4. The air compression system according to claim 1, wherein said flexible diaphragm is biased by a compression spring and the tension of said compression spring is adjustable by means of a screw cap.

5. The air compression system according to claim 2, wherein said first valve body is biased toward said flexible diaphragm by a compression spring.

6. The air compression system according to claim 2, wherein said second valve body is biased toward said flexible diaphragm by a compression spring and the tension of said compression spring is adjustable by means of a set screw.

* * * * *